US007193529B1

(12) United States Patent
Shah

(10) Patent No.: US 7,193,529 B1
(45) Date of Patent: Mar. 20, 2007

(54) TRAFFIC SIGNAL FAILURE NOTIFICATION SYSTEM

(76) Inventor: Ahmad Shah, 23040 Widgeon Pl., Canyon Lake, CA (US) 92587

( * ) Notice: Subject to any disclaimer, the term of this patent is extended or adjusted under 35 U.S.C. 154(b) by 203 days.

(21) Appl. No.: 11/075,309

(22) Filed: Mar. 9, 2005

(51) Int. Cl.
*E01F 9/00* (2006.01)
*G08G 1/095* (2006.01)
*G08G 1/097* (2006.01)
*G09F 7/00* (2006.01)

(52) U.S. Cl. ..... 340/907; 340/931; 116/63 R; 40/601

(58) Field of Classification Search ..... 248/542, 248/214, 543, 218.4–219.4; 116/63 P, 63 R; 49/13, 14; 340/907–932.1; 40/601, 612, 40/368, 369, 556, 600, 606.16, 607.01, 607.1–607.12
See application file for complete search history.

(56) References Cited

U.S. PATENT DOCUMENTS 1,326,009 A 12/1919 Wetter
1,407,444 A 2/1922 Smith et al.
3,854,685 A * 12/1974 Parduhn ..... 248/214
3,863,214 A 1/1975 Kerr, Jr.
4,642,605 A 2/1987 Karp
4,871,995 A 10/1989 Hoang
5,400,535 A * 3/1995 Schomaker ..... 40/607.11
5,474,016 A * 12/1995 Haney ..... 116/28 R
5,504,481 A 4/1996 Wys
6,701,650 B1 * 3/2004 Cieciuch et al. ..... 40/601

* cited by examiner

*Primary Examiner*—Daniel Wu
*Assistant Examiner*—Jennifer Mehmood

(57) ABSTRACT

A signaling system includes a housing that has monolithically formed sides defining a cavity therebetween and an open rear face. A pair of U-shaped guide rails are fastened to the housing and extend vertically away therefrom along a longitudinal length of the system. A sign board is registered along the axis and includes edge portions intercalated within the guide rails. A shield is positional in front of the sign board. The system includes an electromagnetic mechanism for maintaining the shield at a lowered position when an external power source is on, a mechanism for adapting the shield to a raised position when an external power source is off, and a mechanism for automatically lowering the shield after the external power source is reactivated. The automatic lowering mechanism includes spacers and fasteners passing through the spacers to attach the automatic lowering mechanism to the housing while intercalating the adapting mechanism therebetween.

18 Claims, 6 Drawing Sheets

TRAFFIC SIGNAL FAILURE NOTIFICATION SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to notification systems and, more particularly, to a traffic signal failure notification system for notifying oncoming vehicles and pedestrians of an inoperative traffic signal.

2. Prior Art

Power outages in today's world not only result in an inconvenience at home but also pose a safety threat to motorists. The reason for this is that the traffic signals used to direct traffic are directly connected to the main power supply sources of the cities, thus a loss of power will result in the loss of proper functioning of such traffic signals. Under these circumstances motorists may become nervous and disoriented, not knowing whose turn it is next to pass through an intersection etc., thus increasing the risk of an accident occurring.

Supplemental visual display devices for use with a traffic signal and which are activated in response to a power failure of the traffic signal are well known in the art. Such a signaling device generally displays a perceptible signal as an indicator of an immediate or emergent condition of safety concern arises. The exigency of the condition is conveyed by a universal interpretation of the displayed signal.

One example shows a supplemental visual display for a traffic signal with a stop sign attached to the end of a signal arm. An electromagnet holds the arm in place against the side of the signal light during operation of the light. The interruption of an electrical signal from the controller to the electromagnet will cause the arm to pivot downwardly and away from the signal light.

Another example similarly shows a power failure warning responsive device having an arm pivotally mounted to the signal light and held in place by an electromagnet. When the power supply to the light is interrupted, the electromagnet releases the arm. An electromagnet releases the arm to pivot downwardly and away from the signal light once electrical flow has been interrupted to the traffic light. A collapsible warning sign unfolds between the arm and the side of the traffic light.

The disadvantage of the above devices is that a driver's first instinct is to always focus on the traffic light when entering an intersection. Therefore, the driver may not have adequate response time when traveling at high speed to realize that the light is inoperative and to then shift his attention to the warning sign which is arranged at the side of the stop light.

Accordingly, a need remains for a traffic signal failure notification system in order to overcome the above-noted shortcomings. The present invention satisfies such a need by providing a traffic signal failure notification system that increases safety during power outages, is easily noticeable upon activation, and is durable in design. Such a notification system conveniently operates automatically at the beginning and the end of a power failure, and provides motorists with the necessary traffic stop sign needed for intersection traffic control during power failure situations.

BRIEF SUMMARY OF THE INVENTION

In view of the foregoing background, it is therefore an object of the present invention to provide a traffic signal failure notification system. These and other objects, features, and advantages of the invention are provided by an emergency signaling system for advantageously notifying oncoming vehicles and pedestrians of an inoperative traffic signal.

The emergency signaling system includes a protective housing that has a rigid structure sized and shaped for being securely conjoined to a support structure adjacent to a traffic light. Such a housing has a plurality of monolithically formed sides defining a cavity therebetween wherein a rear face of the housing is open.

A pair of elongated and U-shaped guide rails are fastened to the housing and extend vertically away therefrom such that the guide rails become equidistantly spaced from a centrally disposed axis traversing the housing. Such guide rails extend substantially parallel to the axis and along an entire longitudinal length of the emergency signaling system.

A sign board is centrally registered along the axis and includes a pair of opposed edge portions equidistantly spaced therefrom. Such edge portions are slidably intercalated within the guide rails in such a manner that the sign board is advantageously restricted from moving along a longitudinal length of the housing.

A shield is selectively positional in front of the sign board in such a manner to effectively hide the sign board from oncoming pedestrians and vehicles when the traffic signal is at an operable state. Such a shield is formed from magnetic material. The shield preferably includes a plurality of elongated members longitudinally juxtaposed along a length of the shield such that the shield can advantageously be repeatedly adapted between rolled and unrolled positions during operating conditions.

An electromagnetic mechanism is included for maintaining the shield at a lowered position when an external power supply source is at an active state. Such an electromagnetic mechanism is positioned adjacent to a bottom edge portion of the sign board for effectively maintaining the shield at a lowered position and thereby advantageously prevents undesirable foreign elements from contacting the sign board during non-operating conditions.

Such an electromagnetic mechanism preferably includes an electromagnetic latch secured to the sign board and confronting a rear surface of the shield such that the latch is effectively hidden behind the shield during non-operating conditions. A conductive lead has opposed end portions electrically coupled to the latch and the adapting mechanism. Such a latch directly communicates with the external power supply source in such a manner that the latch loses magnetism, advantageously causing the shield to recoil upwardly to the raised position when the external power supply source is interrupted. The electromagnetic mechanism preferably further includes a plurality of clips engaged to the conductive lead for adjoining the conductive lead adjacent to one of the guide rails and the shield.

A mechanism is included for effectively adapting the shield to a raised position when an external power source is interrupted for a predetermined time interval. Such an adapting mechanism preferably includes an elongated and cylindrical spool nested within the housing that has opposed end portions registered orthogonal to the axis, a base plate sized and shaped for confronting one end portion of the housing, and a casing and a spring-loaded actuator nested therein. Such a casing is affixed to the base plate and protrudes laterally away therefrom. The spring-loaded actuator is at a tensed state when the shield is adapted to the lowered position such that the spring-loaded actuator effectively recoils to an equilibrium state when the electromagnetic latch loses magnetism.

The present system further includes a mechanism for conveniently automatically lowering the shield to the lowered position after the external power supply source is reactivated from an inactive state. Such an automatic lowering mechanism includes a plurality of spacers selectively positioned along the adapting mechanism such that the adapting mechanism becomes inwardly situated from the automatic lowering mechanism.

The automatic lowering mechanism preferably includes a plurality of end caps conjoined to opposed end portions of the housing wherein one of the end caps confronts the casing and the base plate in such a manner as to cover the spring-loaded actuator. A rotary motor including a drive axle is operably connected thereto and extends outwardly therefrom. Such a drive axle protrudes laterally towards the housing and passes through the one end cap and the casing. The drive axle is securely conjoined to the spool in such a manner as to effectively cause the spool and the shield to rotate in sync with the motor after the external power supply source is reactivated from an inactive state. A plurality of elongated fasteners pass through the spaces in such a manner to securely attach the automatic lowering mechanism to the housing while intercalating the adapting mechanism therebetween.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
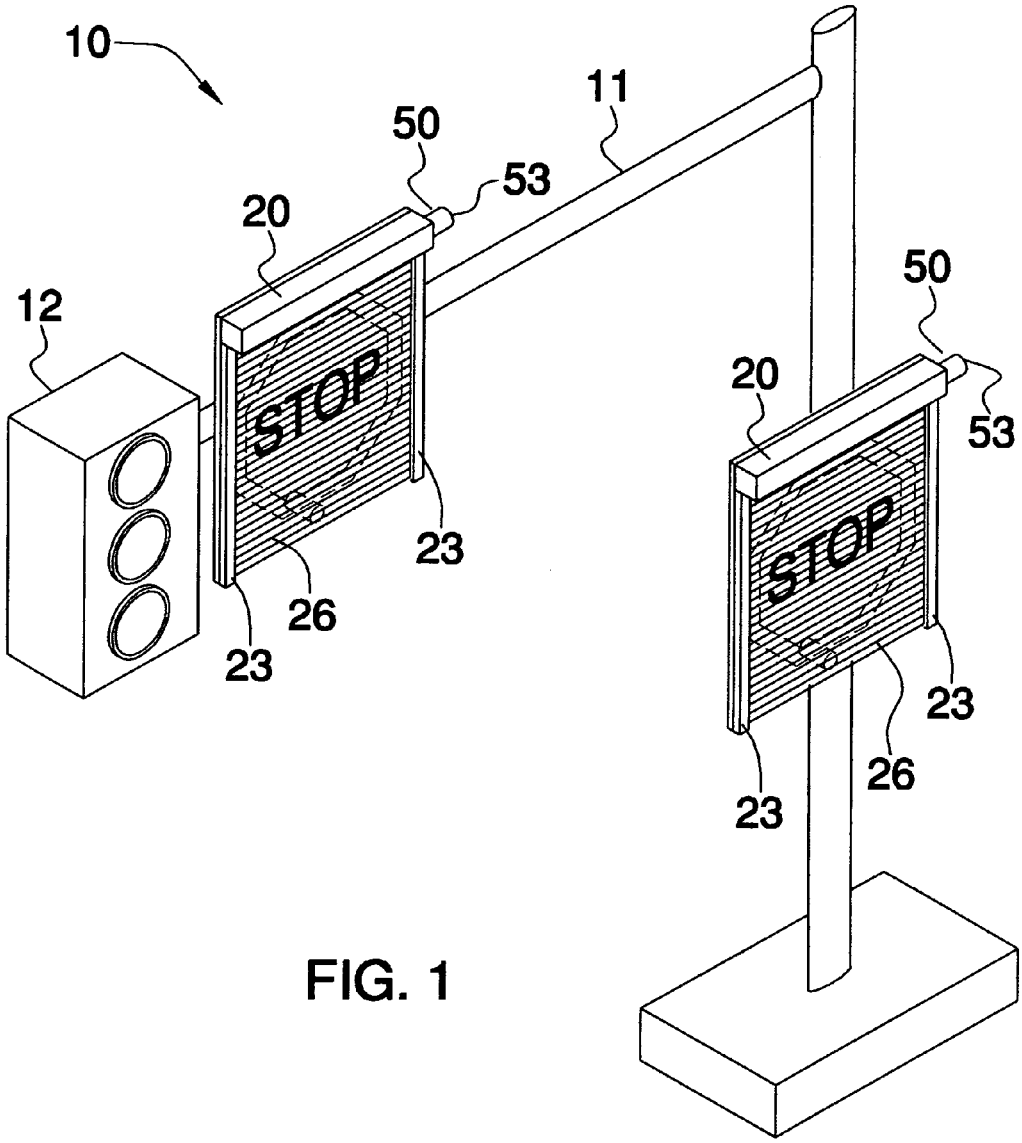
FIG. 1 is a perspective view showing a traffic signal failure notification system with the shield at a lowered position, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1–6 by the reference numeral 10 and is intended to provide a traffic signal failure notification system. It should be understood that the system 10 may be used to indicate many different types of signal failures, and should not be limited in use to only traffic signals.

Referring initially to FIG. 1, the system 10 includes a protective housing 20 that has a rigid structure sized and shaped for being securely conjoined to a support structure 11 adjacent to a traffic light 12. Of course, the housing 20 may be positioned at any other suitable location on the support structure 11, and more than one system 10 may be attached to any one particular support structure 11, as is obvious to a person of ordinary skill in the art. Such a housing 20 has a plurality of monolithically formed sides 21 defining a cavity therebetween wherein a rear face 22 of the housing 20 is open. An open rear face 22 is critical to the proper functioning of the system 10 in order for the shield 26 (described herein below) to be raised and lowered uninterrupted and automatically.

Figure 4:
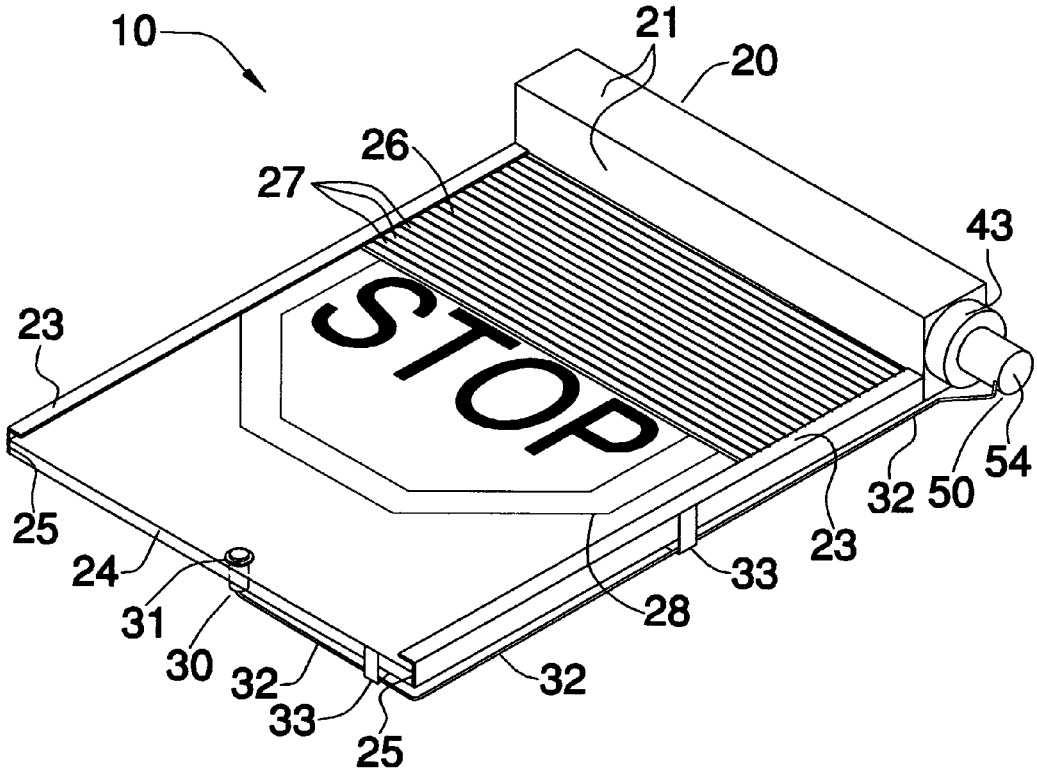
FIG. 4 is an enlarged perspective view of the system shown in FIGS. 1 and 2, showing the shield at a partially raised position.

Referring to FIGS. 1 and 4, a pair of elongated and U-shaped guide rails 23 are fastened to the housing 20 and extend vertically away therefrom such that the guide rails 23 become equidistantly spaced from a centrally disposed axis traversing the housing 20. Such guide rails 23 extend substantially parallel to the axis and along an entire longitudinal length of the emergency signaling system 10.

Figure 2:
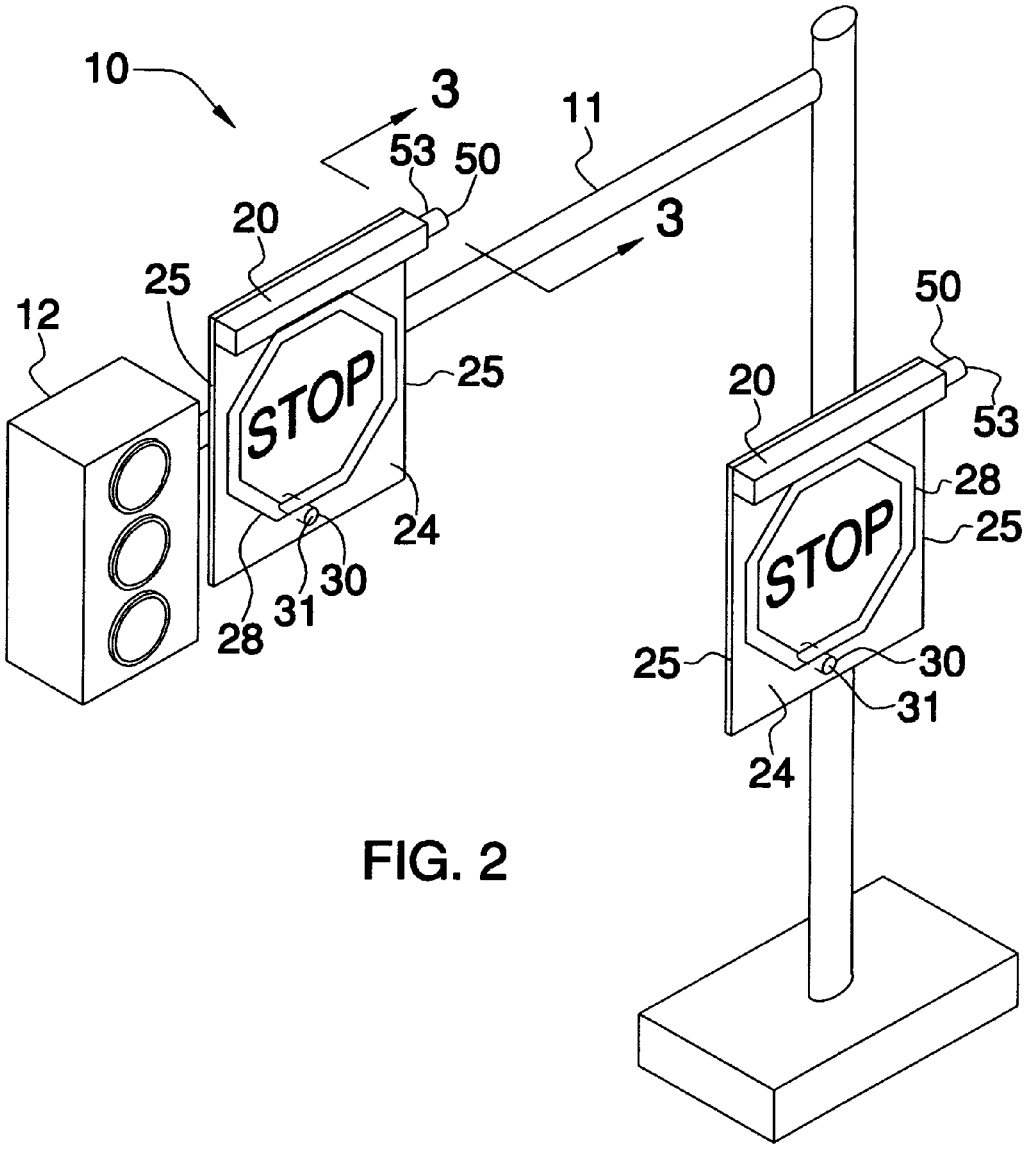
FIG. 2 is perspective view of the system shown in FIG. 1, showing the shield at a raised position corresponding to an active state.
Figure 3:
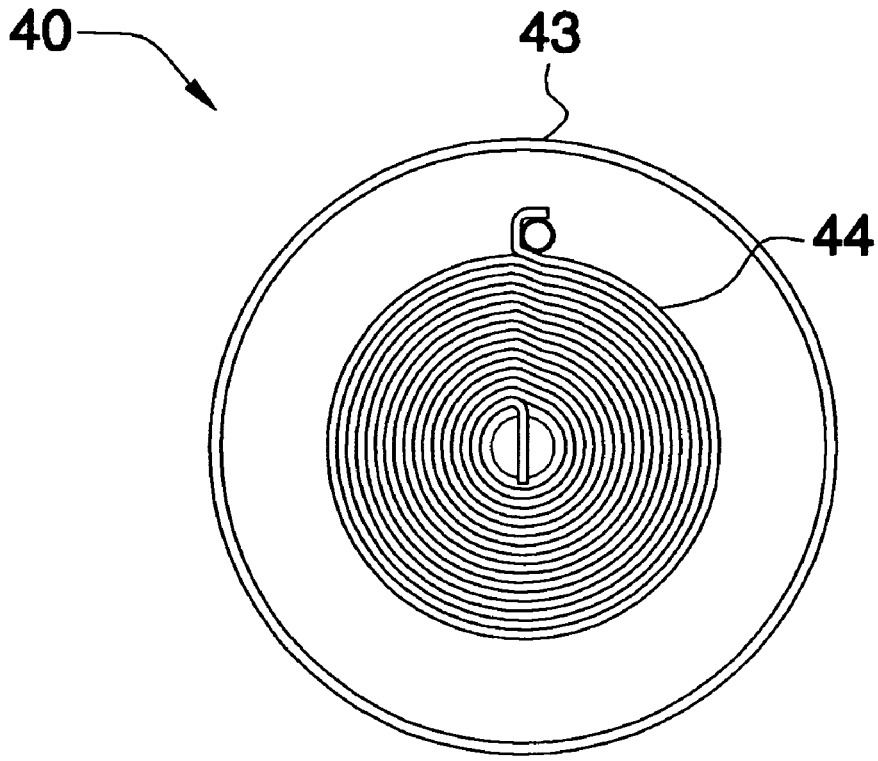
FIG. 3 is a cross-sectional view of the system shown in FIG. 2, taken along line 3—3.

Referring to FIGS. 2 and 4, a sign board 24 is centrally registered along the axis and includes a pair of opposed edge portions 25 equidistantly spaced therefrom. Such edge portions 25 are slidably intercalated within the guide rails 23 in such a manner that the sign board 24 is advantageously restricted from moving along a longitudinal length of the housing 20. The intercalated nature of the edge portions 25 and the guide rails 23 is also vital with respect to preventing the sign board 24 from pivoting forwards and backwards in relation to the housing 20, which would hinder a motorist's and a pedestrians' ability to see the sign board 24. The sign board 24 further includes surface indicia 28 located on a front surface thereof for displaying an emergency message. In general, such surface indicia 28 consist of a stop sign. Of course, alternate emergency messages may be displayed by the sign board surface indicia 28. For example, a detour route in the event of an emergency may be indicated, as is obvious to a person skilled in the art.

Referring to FIGS. 1, 4, 5 and 6, a shield 26 is selectively positional in front of the sign board 24 in such a manner to effectively hide the sign board 24 from oncoming pedestrians and vehicles when the traffic signal 12 is at an operable state. Such a shield 26 is formed from magnetic material, which is essential to ensure proper functioning of the electromagnetic mechanism 30 (described herein below). The shield 26 includes a plurality of elongated members 27 longitudinally juxtaposed along a length of the shield 26 such that the shield 26 can advantageously be repeatedly adapted between rolled and unrolled positions during operating conditions.

Figure 6:
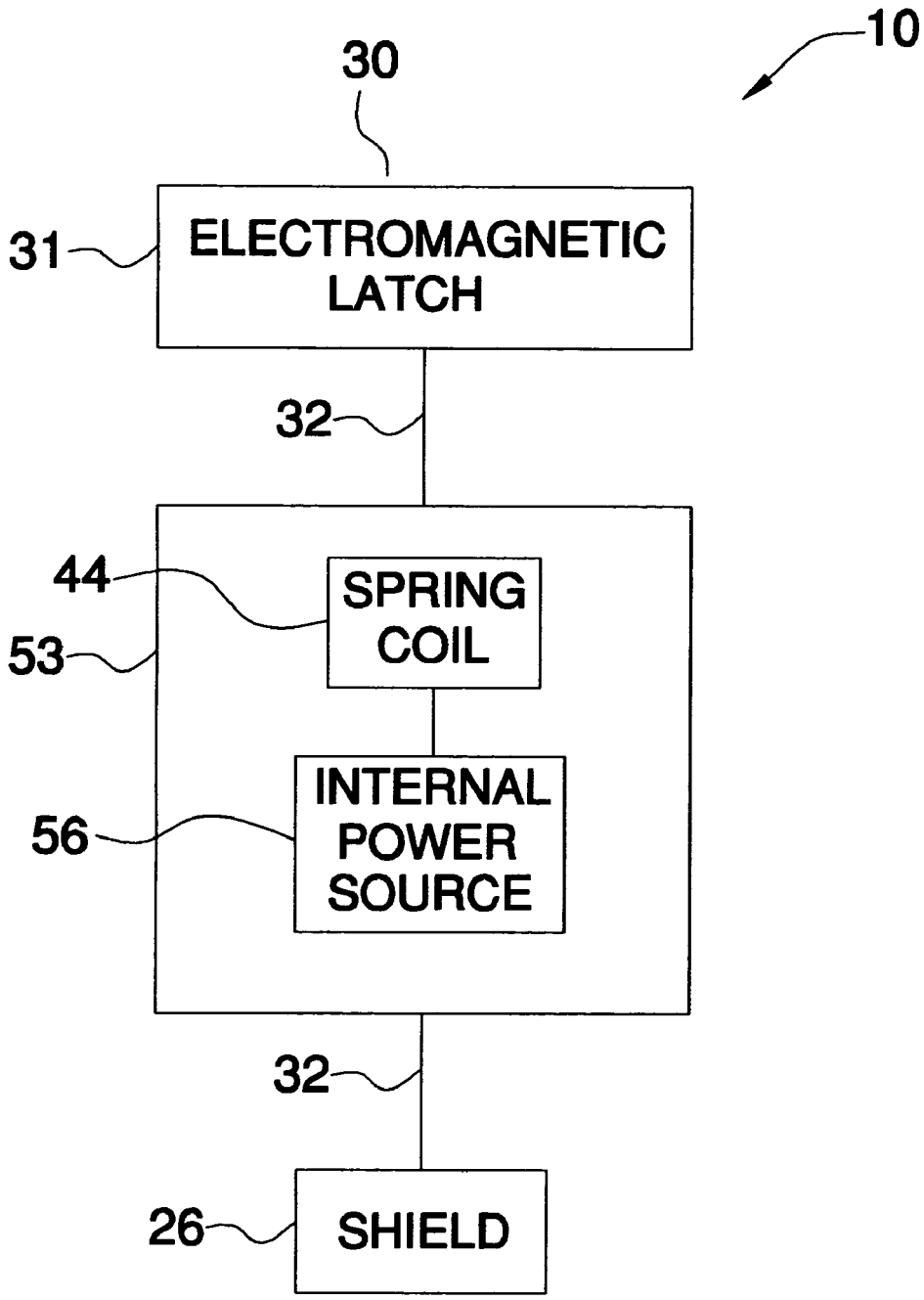
FIG. 6 is a schematic block diagram of the system shown in FIG. 1.

Referring to FIGS. 2, 4 and 6, an electromagnetic mechanism 30 is included for maintaining the shield 26 at a lowered position when an external power supply source is at an active state. Such an electromagnetic mechanism 30 is positioned adjacent to a bottom edge portion of the sign board 24 for effectively maintaining the shield 26 at a lowered position and thereby advantageously preventing undesirable foreign elements from contacting the sign board 24 during non-operating conditions. Positioning the electromagnetic mechanism 30 adjacent to a bottom portion of the shield 26 is also advantageous and essential for effectively covering the entire sign board 24 so that motorists and pedestrians do not become confused as to whether they should obey the traffic signal 12 or the sign board 24.

Still referring to FIGS. 2, 4 and 6, such an electromagnetic mechanism 30 includes an electromagnetic latch 31 secured to the sign board 24 and confronting a rear surface of the shield 26 such that the latch 31 is effectively hidden behind the shield 26 during non-operating conditions. A conductive lead 32 has opposed end portions electrically coupled to the latch 31 and the adapting mechanism 40 (described herein below). Such a latch 31 directly communicates with the external power supply source in such a manner that the latch 31 loses magnetism, advantageously causing the shield 26 to recoil upwardly to the raised position when the external power supply source is interrupted. The electromagnetic mechanism 30 further includes a plurality of clips 33 engaged to the conductive lead 32 for adjoining the conductive lead 32 adjacent to one of the guide rails 23 and the shield 26. Of course, the conductive lead 32 may be adjoined to the guide rails 23 by alternate means, as is obvious to a person of ordinary skill in the art.

Referring to FIGS. 1 through 6, a mechanism 40 is included for effectively adapting the shield 26 to a raised position when an external power source is interrupted for a predetermined time interval. Such an adapting mechanism 40 includes an elongated and cylindrical spool 41 nested within the housing 20 that has opposed end portions registered orthogonal to the axis. A base plate 42 is sized and shaped for confronting one end portion of the housing 20 and a casing 43 and a spring-loaded actuator 44 are nested therein. Such a casing 43 is affixed to the base plate 42 and protrudes laterally away therefrom. The spring-loaded actuator 44 is at a tensed state when the shield 26 is adapted to the lowered position such that the spring-loaded actuator 44 effectively recoils to an equilibrium state when the electromagnetic latch 31 loses magnetism, which effectively causes the shield 26 to be drawn into the housing 20 about the cylindrical spool 41. In such an event, the elongated members 27 of the shield 26 are critical for advantageously allowing the shield 26 to assume the most compact shape about the spool 41.

Figure 5:
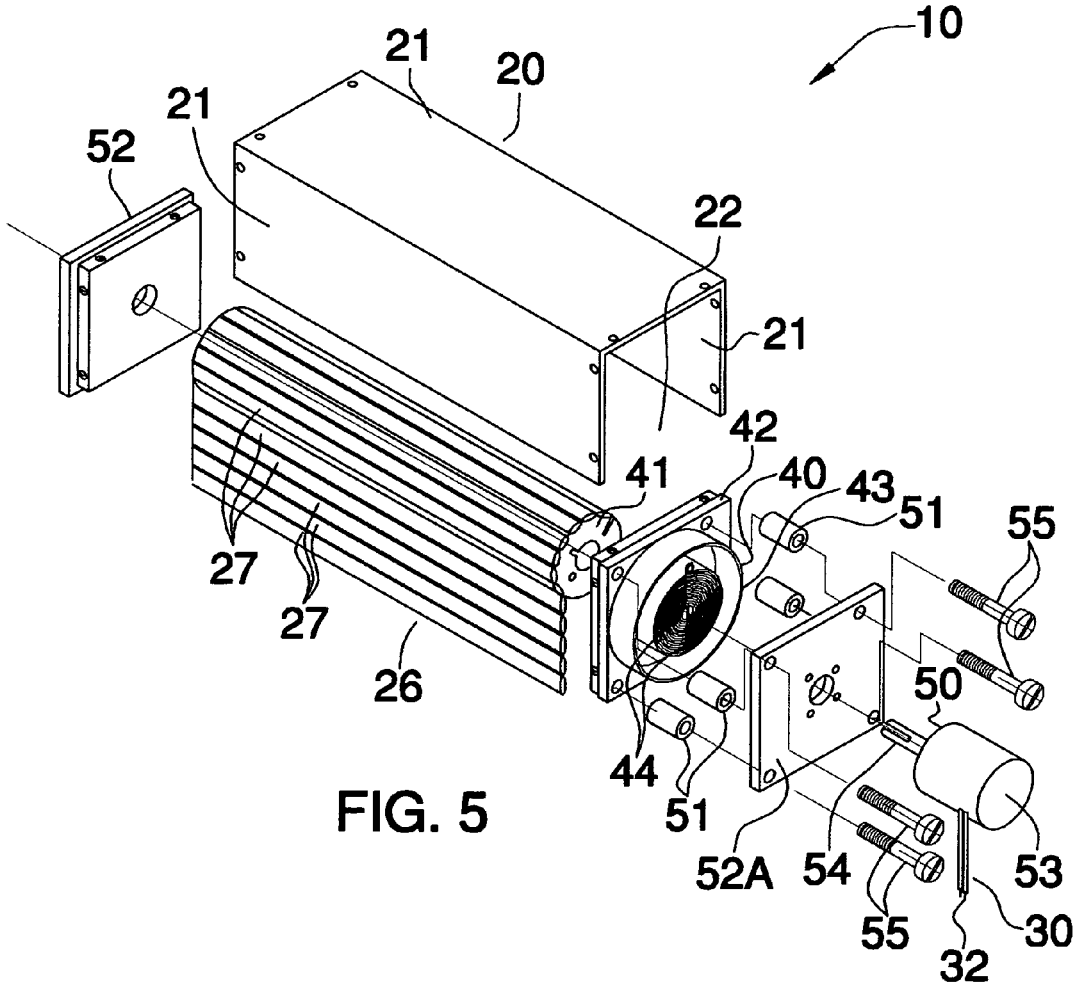
FIG. 5 is an exploded view of the automatic lowering mechanism.

Referring to FIG. 5, the present system 10 further includes a mechanism 50 for conveniently automatically lowering the shield 26 to the lowered position after the external power supply source is reactivated from an inactive state, thus allowing motorists and pedestrians to focus their attention on the traffic signal 12 and not be confused by the sign board 24. Such an automatic lowering mechanism 50 includes a plurality of spacers 51 selectively positioned along the adapting mechanism 40 such that the adapting mechanism 40 becomes inwardly situated from the automatic lowering mechanism 50.

Still referring to FIG. 5, the automatic lowering mechanism 50 includes a plurality of end caps 52 conjoined to opposed end portions of the housing 20 wherein one 52A of the end caps 52 confronts the casing 43 and the base plate 42 in such a manner as to cover the spring-loaded actuator 44. A rotary motor 53 including a drive axle 54 is operably connected thereto and extends outwardly therefrom. Such a drive axle 54 protrudes laterally towards the housing 20 and passes through the one end cap 52A and the casing 43. The drive axle 52 is securely conjoined to the spool 41 in such a manner as to effectively cause the spool 41 and the shield 26 to rotate in sync with the motor 53 after the external power supply source is reactivated from an inactive state, thus allowing the shield 26 to be lowered at the appropriate time. Such a motor 53 further includes an internal power source 56, independent of the external power source, which is vital for the proper functioning of the system 10 during the event of a power failure because the system 10 when the external power supply source is affected by the power outage.

Again referring to FIG. 5, a plurality of elongated fasteners 55 pass through the spacers 51 in such a manner to securely attach the automatic lowering mechanism 50 to the housing 20 while intercalating the adapting mechanism 40 therebetween.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An emergency signaling system for notifying oncoming vehicles and pedestrians of an inoperative traffic signal, said emergency signaling system comprising:

a protective housing having a rigid structure sized and shaped for being securely conjoined to a support structure adjacent to a traffic light, said housing having a plurality of monolithically formed sides defining a cavity therebetween wherein a rear face of said housing is open;

a pair of elongated and U-shaped guide rails fastened to said housing and extending vertically away therefrom such that said guide rails become equidistantly spaced from a centrally disposed axis traversing said housing, said guide rails extending substantially parallel to the axis and along an entire longitudinal length of said emergency signaling system;

a sign board centrally registered along the axis and including a pair of opposed edge portions equidistantly spaced therefrom, said edge portions being slidably intercalated within said guide rails in such a manner that said sign board is restricted from moving along a longitudinal length of said housing;

a shield selectively positional in front of said sign board in such a manner to hide said sign board from oncoming pedestrians and vehicles when the traffic signal is at an operable state, said shield being formed from magnetic material;

electromagnetic means for maintaining said shield at a lowered position when an external power supply source is at an active state;

means for adapting said shield to a raised position when an external power source is interrupted for a predetermined time interval; and means for automatically lowering said shield to the lowered position after the external power supply source is reactivated from an inactive state.

2. The system of claim 1, wherein said electromagnetic means comprises:

an electromagnetic latch secured to said sign board and confronting a rear surface of said shield such that said latch is hidden behind said shield during non-operating conditions; and a conductive lead having opposed end portions electrically coupled to said latch and said adapting means;

wherein said latch directly communicates with the external power supply source in such a manner that said latch loses magnetism and causes said shield to recoil upwardly to the raised position when the external power supply source is interrupted.

3. The system of claim 2, wherein said electromagnetic means further comprises: a plurality of clips engaged to said conductive lead for adjoining said conductive lead adjacent one said guide rails and said shield.

4. The system of claim 2, wherein said adapting means comprises:

an elongated and cylindrical spool nested within said housing and having opposed end portions registered orthogonal to the axis;

a base plate sized and shaped for confronting one end portion of said housing; and a casing and a spring-loaded actuator nested therein, said casing being affixed to said base plate and protruding laterally away therefrom;

wherein said spring-loaded actuator is at a tensed state when said shield is adapted to the lowered position such that said spring-loaded actuator recoils to an equilibrium state when said electromagnetic latch loses magnetism.

5. The system of claim 4, wherein said automatic lowering means comprises:

a plurality of end caps conjoined to opposed end portions of said housing wherein one said end caps confronts said casing and said base plate in such a manner to cover said spring-loaded actuator; and a rotary motor including a drive axle operably connected thereto and extending outwardly therefrom, said drive axle protruding laterally towards said housing and passing through said one end cap and said casing, said drive axle being securely conjoined to said spool in such a manner to cause said spool and said shield to rotate in sync with said motor after the external power supply source is reactivated from an inactive state.

6. The system of claim 1, wherein said shield comprises: a plurality of elongated members longitudinally juxtaposed along a length of said shield such that said shield can be repeatedly adapted between rolled and unrolled positions during operating conditions.

7. An emergency signaling system for notifying oncoming vehicles and pedestrians of an inoperative traffic signal, said emergency signaling system comprising:

a protective housing having a rigid structure sized and shaped for being securely conjoined to a support structure adjacent to a traffic light, said housing having a plurality of monolithically formed sides defining a cavity therebetween wherein a rear face of said housing is open;

a pair of elongated and U-shaped guide rails fastened to said housing and extending vertically away therefrom such that said guide rails become equidistantly spaced from a centrally disposed axis traversing said housing, said guide rails extending substantially parallel to the axis and along an entire longitudinal length of said emergency signaling system;

a sign board centrally registered along the axis and including a pair of opposed edge portions equidistantly spaced therefrom, said edge portions being slidably intercalated within said guide rails in such a manner that said sign board is restricted from moving along a longitudinal length of said housing;

a shield selectively positional in front of said sign board in such a manner to hide said sign board from oncoming pedestrians and vehicles when the traffic signal is at an operable state, said shield being formed from magnetic material;

electromagnetic means for maintaining said shield at a lowered position when an external power supply source is at an active state;

means for adapting said shield to a raised position when an external power source is interrupted for a predetermined time interval; and means for automatically lowering said shield to the lowered position after the external power supply source is reactivated from an inactive state;

wherein said automatic lowering means comprises a plurality of spacers selectively positioned along said adapting means such that said adapting means becomes inwardly situated from said automatic lowering means, and a plurality of elongated fasteners passing through said spacers in such a manner to securely attach said automatic lowering means to said housing while intercalating said adapting means therebetween.

8. The system of claim 7, wherein said electromagnetic means comprises:

an electromagnetic latch secured to said sign board and confronting a rear surface of said shield such that said latch is hidden behind said shield during non-operating conditions; and a conductive lead having opposed end portions electrically coupled to said latch and said adapting means;

wherein said latch directly communicates with the external power supply source in such a manner that said latch loses magnetism and causes said shield to recoil upwardly to the raised position when the external power supply source is interrupted.

9. The system of claim 8, wherein said electromagnetic means further comprises: a plurality of clips engaged to said conductive lead for adjoining said conductive lead adjacent one said guide rails and said shield.

10. The system of claim 8, wherein said adapting means comprises:

an elongated and cylindrical spool nested within said housing and having opposed end portions registered orthogonal to the axis;

a base plate sized and shaped for confronting one end portion of said housing; and a casing and a spring-loaded actuator nested therein, said casing being affixed to said base plate and protruding laterally away therefrom;

wherein said spring-loaded actuator is at a tensed state when said shield is adapted to the lowered position such that said spring-loaded actuator recoils to an equilibrium state when said electromagnetic latch loses magnetism.

11. The system of claim 10, wherein said automatic lowering means comprises:

a plurality of end caps conjoined to opposed end portions of said housing wherein one said end caps confronts said casing and said base plate in such a manner to cover said spring-loaded actuator; and a rotary motor including a drive axle operably connected thereto and extending outwardly therefrom, said drive axle protruding laterally towards said housing and passing through said one end cap and said casing, said drive axle being securely conjoined to said spool in such a manner to cause said spool and said shield to rotate in sync with said motor after the external power supply source is reactivated from an inactive state.

12. The system of claim 8, wherein said shield comprises: a plurality of elongated members longitudinally juxtaposed along a length of said shield such that said shield can be repeatedly adapted between rolled and unrolled positions during operating conditions.

13. An emergency signaling system for notifying oncoming vehicles and pedestrians of an inoperative traffic signal, said emergency signaling system comprising:

a protective housing having a rigid structure sized and shaped for being securely conjoined to a support structure adjacent to a traffic light, said housing having a plurality of monolithically formed sides defining a cavity therebetween wherein a rear face of said housing is open;

a pair of elongated and U-shaped guide rails fastened to said housing and extending vertically away therefrom such that said guide rails become equidistantly spaced from a centrally disposed axis traversing said housing, said guide rails extending substantially parallel to the axis and along an entire longitudinal length of said emergency signaling system;

a sign board centrally registered along the axis and including a pair of opposed edge portions equidistantly spaced therefrom, said edge portions being slidably intercalated within said guide rails in such a manner that said sign board is restricted from moving along a longitudinal length of said housing;

a shield selectively positional in front of said sign board in such a manner to hide said sign board from oncoming pedestrians and vehicles when the traffic signal is at an operable state, said shield being formed from magnetic material;

electromagnetic means for maintaining said shield at a lowered position when an external power supply source is at an active state;

wherein said electromagnetic means is positioned adjacent a bottom edge portion of said sign board for effectively maintaining said shield at a lowered position and thereby preventing undesirable foreign elements from contacting said sign board during non-operating conditions;

means for adapting said shield to a raised position when an external power source is interrupted for a predetermined time interval; and means for automatically lowering said shield to the lowered position after the external power supply source is reactivated from an inactive state;

wherein said automatic lowering means comprises a plurality of spacers selectively positioned along said adapting means such that said adapting means becomes inwardly situated from said automatic lowering means, and a plurality of elongated fasteners passing through said spacers in such a manner to securely attach said automatic lowering means to said housing while intercalating said adapting means therebetween.

14. The system of claim 13, wherein said electromagnetic means comprises:

an electromagnetic latch secured to said sign board and confronting a rear surface of said shield such that said latch is hidden behind said shield during non-operating conditions; and a conductive lead having opposed end portions electrically coupled to said latch and said adapting means;

wherein said latch directly communicates with the external power supply source in such a manner that said latch loses magnetism and causes said shield to recoil upwardly to the raised position when the external power supply source is interrupted.

15. The system of claim 14, wherein said electromagnetic means further comprises: a plurality of clips engaged to said conductive lead for adjoining said conductive lead adjacent one said guide rails and said shield.

16. The system of claim 14, wherein said adapting means comprises:

an elongated and cylindrical spool nested within said housing and having opposed end portions registered orthogonal to the axis;

a base plate sized and shaped for confronting one end portion of said housing; and a casing and a spring-loaded actuator nested therein, said casing being affixed to said base plate and protruding laterally away therefrom;

wherein said spring-loaded actuator is at a tensed state when said shield is adapted to the lowered position such that said spring-loaded actuator recoils to an equilibrium state when said electromagnetic latch loses magnetism.

17. The system of claim 16, wherein said automatic lowering means comprises:

a plurality of end caps conjoined to opposed end portions of said housing wherein one said end caps confronts said casing and said base plate in such a manner to cover said spring-loaded actuator; and a rotary motor including a drive axle operably connected thereto and extending outwardly therefrom, said drive axle protruding laterally towards said housing and passing through said one end cap and said casing, said drive axle being securely conjoined to said spool in such a manner to cause said spool and said shield to rotate in sync with said motor after the external power supply source is reactivated from an inactive state.

18. The system of claim 13, wherein said shield comprises: a plurality of elongated members longitudinally juxtaposed along a length of said shield such that said shield can be repeatedly adapted between rolled and unrolled positions during operating conditions.

* * * * *